US010913286B2

(12) United States Patent
Nagatsuka et al.

(10) Patent No.: US 10,913,286 B2
(45) Date of Patent: Feb. 9, 2021

(54) LIQUID DISCHARGE APPARATUS AND CONTROL METHOD

(71) Applicants: Yuki Nagatsuka, Kanagawa (JP); Hiroshi Noda, Kanagawa (JP)

(72) Inventors: Yuki Nagatsuka, Kanagawa (JP); Hiroshi Noda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/580,788

(22) Filed: Sep. 24, 2019

(65) Prior Publication Data

US 2020/0101753 A1 Apr. 2, 2020

(30) Foreign Application Priority Data

Sep. 28, 2018 (JP) ..... 2018-184935
Jun. 19, 2019 (JP) ..... 2019-113863

(51) Int. Cl.
*B41J 2/175* (2006.01)
*B41J 2/135* (2006.01)

(52) U.S. Cl.
CPC ..... *B41J 2/17596* (2013.01); *B41J 2/135* (2013.01)

(58) Field of Classification Search
CPC ..... B41J 2/17596; B41J 2/17566; B41J 2/17506; B41J 2/175
USPC ..... 347/7, 84, 85
See application file for complete search history.

(56) References Cited

U.S. PATENT DOCUMENTS 4,977,413 A 12/1990 Yamanaka et al.
7,963,626 B2 * 6/2011 Umeda ..... B41J 2/17596 347/19
9,340,028 B2 * 5/2016 Hassaka ..... B41J 2/17513
10,195,867 B2 * 2/2019 Bayona ..... B41J 2/17596
2005/0035985 A1 2/2005 Taguchi et al.

FOREIGN PATENT DOCUMENTS

JP S63257643 A 10/1988
JP S63257645 A 10/1988
JP H11216874 A 8/1999
JP 2006205687 A 8/2006
JP 2010-030086 2/2010

OTHER PUBLICATIONS

Chinese Office Action; Application CN201910915435.1; dated Sep. 21, 2020.

* cited by examiner

*Primary Examiner* — An H Do
(74) *Attorney, Agent, or Firm* — Duft & Bornsen, PC

(57) ABSTRACT

A liquid discharge apparatus includes a liquid discharge head, a pump, tanks, a supply path, liquid supply regulators, a pressure detector, and control circuitry. The liquid supply regulators are provided for each of the tanks and configured to open and block the supply path to regulate supply of a liquid from the tanks to the liquid discharge head. The pressure detector is disposed between the liquid supply regulators and the liquid discharge head in the supply path. The control circuitry is configured to determine a low level tank among the tanks on basis of opening and closing conditions of the liquid supply regulators in a case where the pressure detector detects that a pressure of the supply path is lower than a predetermined value, and control the liquid supply regulators to supply the liquid from at least one tank of the tanks to the liquid discharge head.

11 Claims, 10 Drawing Sheets

LIQUID DISCHARGE APPARATUS AND CONTROL METHOD

CROSS-REFERENCE TO RELATED APPLICATIONS

This patent application is based on and claims priority pursuant to 35 U.S.C. § 119(a) to Japanese Patent Application Nos. 2018-184935, filed on Sep. 28, 2018, and 2019-113863, filed on Jun. 19, 2019, in the Japan Patent Office, the entire disclosure of each of which is hereby incorporated by reference herein.

BACKGROUND

Technical Field

Aspects of the present disclosure relate to a liquid discharge apparatus, a control method, and a recording medium.

Discussion of the Background Art

In recent years, an image forming apparatus used for outputting digitized information or used for duplication of documents has become an indispensable device. A known example of this image forming apparatus includes a liquid discharge apparatus that uses an inkjet method to form an image, in which a liquid is discharged onto a sheet from a liquid discharge head that discharges a liquid (or liquid droplets) while a recording medium such as a sheet is being conveyed.

Liquid such as ink discharged from the liquid discharge head is held in a tank. The ink is supplied from the tank to the liquid discharge head using a pump. When the pump is driven to supply ink to the liquid discharge head in a state where the ink held in the tank has been consumed and the remaining amount of ink is low (hereinafter referred to as "ink end"), the path connecting the tank and the pump turns to a negative pressure state. There is a known technology that uses this phenomenon to detect a change in pressure in a path from a tank to a pump so as to detect the ink end.

SUMMARY

In an aspect of the present disclosure, there is provided a liquid discharge apparatus that includes a liquid discharge head, a pump, a plurality of tanks, a supply path, a plurality of liquid supply regulators, a pressure detector, and control circuitry. The liquid discharge head includes a nozzle configured to discharge a liquid. The pump is configured to supply the liquid to the liquid discharge head. The plurality of tanks is configured to store the liquid. The supply path is configured to supply the liquid from the tanks to the liquid discharge head. The plurality of liquid supply regulators is provided for each of the tanks, and configured to open and block the supply path to regulate supply of the liquid from the tanks to the liquid discharge head. The pressure detector is disposed between the liquid supply regulators and the liquid discharge head in the supply path. The control circuitry is configured to determine a low level tank among the tanks on basis of opening and closing conditions of the liquid supply regulators in a case where the pressure detector detects that a pressure of the supply path is lower than a predetermined value, and control the liquid supply regulators to supply the liquid from at least one tank of the tanks to the liquid discharge head. po In another aspect of the present disclosure, there is provided a control method for a liquid discharge apparatus. The liquid discharge apparatus includes: a liquid discharge head including a nozzle configured to discharge a liquid; a pump configured to supply the liquid to the liquid discharge head; a plurality of tanks configured to store the liquid; a supply path configured to supply the liquid from the tanks to the liquid discharge head; a plurality of liquid supply regulators provided for each of the tanks, and configured to open and block the supply path to regulate supply of the liquid from the tanks to the liquid discharge head; a pressure detector disposed between the liquid supply regulators and the liquid discharge head in the supply path; and control circuitry configured to control the liquid supply regulators to supply the liquid from at least one tank of the tanks to the liquid discharge head. The method includes determining a low level tank among the tanks on basis of opening and closing conditions of the liquid supply regulators in a case where the pressure detector detects that a pressure of the supply path is lower than a predetermined value.

In still another aspect of the present disclosure, there is provided a liquid discharge apparatus that includes a liquid discharge head, a pump, a plurality of tanks, a supply path, a plurality of liquid supply regulators, a pressure detector, and control circuitry. The liquid discharge head includes a nozzle which discharges a liquid. The pump supplies the liquid to the liquid discharge head. The plurality of tanks stores the liquid. The supply path supplies the liquid from the tanks to the liquid discharge head. The plurality of liquid supply regulators is provided for each of the tanks. The liquid supply regulators controls a flow of the liquid from the tanks to the liquid discharge head. The pressure detector is disposed between the liquid supply regulators and the liquid discharge head in the supply path. The control circuitry determines a low level tank among the tanks on basis of a condition of each of the liquid supply regulators in a case where the pressure detector detects a pressure of the supply path that is lower than a predetermined value. The control circuitry controls the liquid supply regulators to supply the liquid from at least one tank of the tanks to the liquid discharge head.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
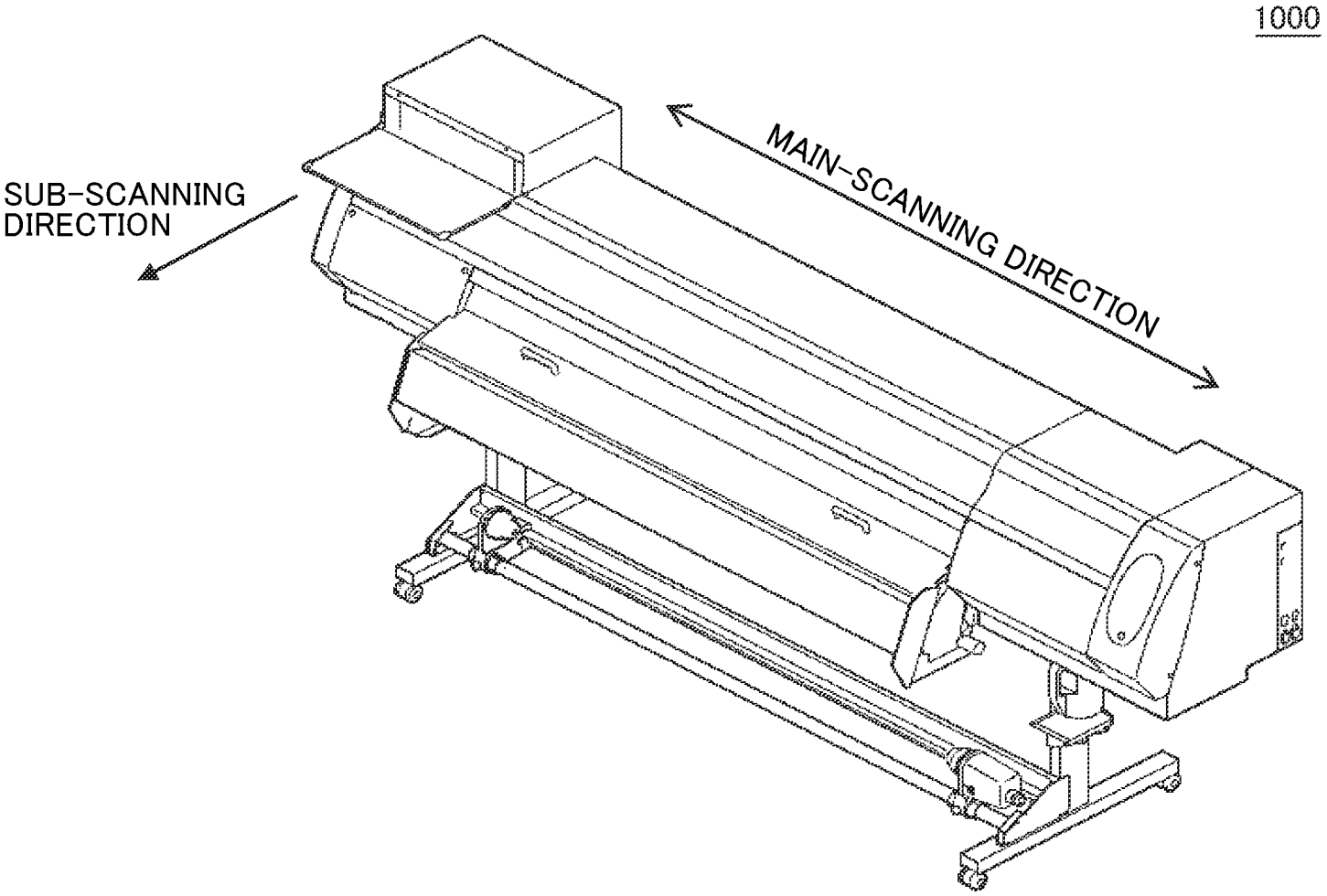
FIG. 1 is an external view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
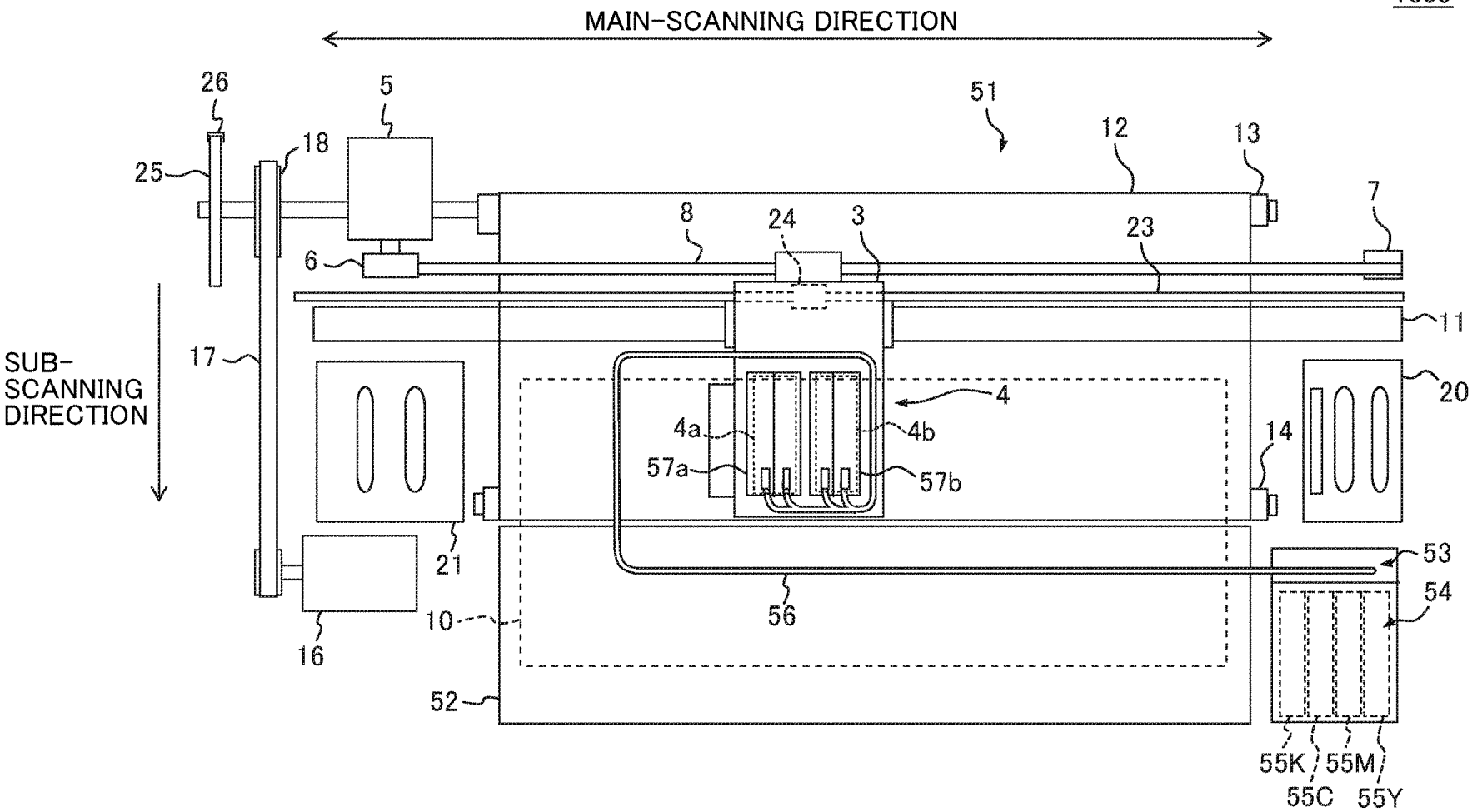
FIG. 2 is a plan view of a liquid discharge apparatus according to an embodiment of the present disclosure.

Hereinafter, embodiments of the present disclosure will be described with reference to the drawings. In the present embodiment, a serial type inkjet recording apparatus will be described as an example of a liquid discharge apparatus 1000. FIG. 1 is an external view of the liquid discharge apparatus 1000 according to the present embodiment. FIG. 2 is a plan view of the liquid discharge apparatus 1000 according to the present embodiment.

The liquid discharge apparatus 1000 uses a main guide member 11 and a sub guide member stretched by left and right side plates so as to movably hold a carriage 3. The carriage 3 uses drive of the main-scanning motor 5 to reciprocate in a main-scanning direction via a timing belt 8 bridged between a driving pulley 6 and a driven pulley 7.

The carriage 3 includes, as image forming units, two liquid discharge heads 4*a* and 4*b* (hereinafter simply referred to as "liquid discharge head 4" when there is no need in particular to distinguish between the two liquid discharge heads) and liquid chambers 57*a* and 57*b* for supplying liquids to the liquid discharge head 4*a* and 4*b*.

Figure 3:
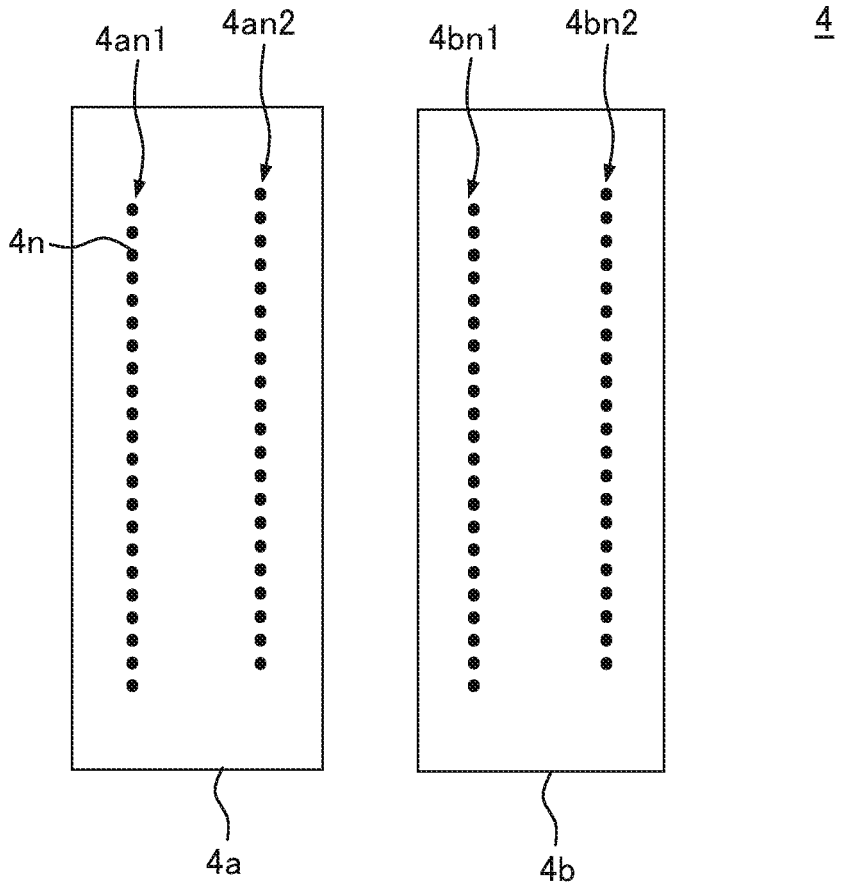
FIG. 3 is an array view of nozzles in a liquid discharge apparatus according to an embodiment of the present disclosure.

As illustrated in FIG. 3, the liquid discharge heads 4*a* and 4*b* have nozzle arrays 4*an*1 and 4*an*2, and 4*bn*1 and 4*bn*2, respectively, each including an array of a plurality of nozzles 4*n*. The nozzle arrays 4*an*1 and 4*an*2 are arranged in a staggered manner with their positions shifted in a nozzle array direction. The nozzle arrays 4*bn*1 and 4*bn*2 have a similar arrangement.

The nozzle array 4*an*1 discharges a liquid of black (K), and the nozzle array 4*an*2 discharges a liquid of cyan (C). The nozzle array 4*bn*1 discharges a liquid of magenta (M), and the nozzle array 4*bn*2 discharges a liquid of yellow (Y). Accordingly, the liquid discharge head 4 can discharge ink of each of colors of yellow (Y), cyan (C), magenta (M), and black (K), for example.

The liquid discharge head 4 may have a configuration including a plurality of nozzle arrays arranging a plurality of nozzles on one nozzle surface to be able to discharge a liquid of specific colors (for example, a configuration to discharge a black liquid from each of two nozzle arrays).

Each of the liquid chambers 57*a* and 57*b* includes a plurality of tank devices by combining two tank devices as a pair corresponding to the two nozzle arrays 4*an*1 and 4*an*2, and 4*bn*1 and 4*bn*2 of the liquid discharge heads 4*a* and 4*b*, respectively. As the liquid chambers 57*a* and 57*b*, tank devices may be provided corresponding to the number of nozzle arrays arranged in the liquid discharge heads 4*a* and 4*b*, or corresponding to the type of liquid to be discharged.

The liquid chambers 57*a* and 57*b* receive supply of the liquid of each of colors from a cartridge 55 containing main tank devices 55K, 55C, 55M, and 55Y storing the liquid of individual colors of CMYK. The cartridge 55 is replaceably attached to a cartridge holder 54.

The cartridge holder 54 includes a pump 53 that supplies a liquid from the cartridge 55 to the liquid chambers 57*a* and 57*b*. A liquid of each of colors is pumped out of the cartridge 55 by the pump 53 and the liquid of each of colors is supplied to the liquid chambers 57*a* and 57*b* via tubes 56 provided separately for each of colors.

Examples of the liquid discharge mechanism in the liquid discharge head 4 can include a piezoelectric actuator such as a piezoelectric element or a thermal actuator using phase change due to liquid film boiling using an electrothermal conversion element such as a heating resistor.

The liquid discharge apparatus 1000 includes a conveyance belt 12 as a conveyance mechanism 51 that conveys a sheet material 10 so as to face the liquid discharge head 4. The conveyance belt 12 is an endless belt and is stretched between a conveyance roller 13 and a tension roller 14.

The conveyance belt 12 is moved in circulation in a sub-scanning direction by the conveyance roller 13 being rotationally driven via a timing belt 17 and a timing pulley 18 by the driving of a sub-scanning motor 16. In addition, the conveyance belt 12 receives a charge from a known charging roller while moving in circulation so as to be charged.

The conveyance mechanism 51 includes a conveyance region 50 disposed, so as to face the sheet material 10, on a downstream side in a traveling direction of the conveyance belt 12 with respect to a region where the liquid is discharged from the liquid discharge head 4. The sheet material 10 is conveyed between the conveyance region 50 and the carriage 3, and the liquid is discharged from the liquid discharge head 4 to the sheet material 10. With this configuration, an image is formed on the sheet material 10.

A maintenance and recovery mechanism 20 for maintaining and recovering the liquid discharge head 4 is disposed at one end of the carriage 3 in the main-scanning direction, and on the other side, there is a dummy discharge receptacle 21 that performs dummy discharge from the liquid discharge head 4 to the side of the conveyance belt 12.

The maintenance and recovery mechanism 20 includes, for example, a cap member for capping a nozzle surface (surface on which the nozzle is formed) of the liquid discharge head 4, a wiper member for wiping the nozzle surface, and a dummy discharge receptacle that discharges a liquid not contributing to image formation.

In addition, an encoder scale 23 in which a predetermined pattern is formed is stretched between both side plates along the main-scanning direction of the carriage 3. The carriage 3 further includes an encoder sensor 24 that reads the pattern of the encoder scale 23. The encoder scale 23 and the encoder sensor 24 constitute a linear encoder (main-scanning encoder) for detecting the movement of the carriage 3.

On the shaft of the conveyance roller 13, a code wheel 25 is attached and an encoder sensor 26 for detecting a pattern formed on the code wheel 25 is provided. The code wheel 25 and the encoder sensor 26 constitute a rotary encoder (sub-scanning encoder) for detecting the movement amount and movement position of the conveyance belt 12.

With the configuration as described above, the liquid discharge apparatus 1000 according to the present embodiment conveys the sheet material 10 in the sub-scanning direction by the circulating movement of the conveyance belt 12 in a state where the sheet material 10 is attracted on the charged conveyance belt 12.

Subsequently, while moving the carriage 3 in the main scanning direction, the liquid discharge head 4 is driven in accordance with a signal for forming an image to discharge the liquid onto the stopped sheet material 10 so as to make a record for one line. Next, the sheet material 10 is conveyed by a predetermined amount, and thereafter a record for the next line is performed.

When a signal that a rear end of the sheet material 10 has reached a recording region is received, the recording operation is finished, and the sheet material 10 is discharged to a sheet discharge tray via the conveyance region 50. Conveyance system of the sheet material 10 is not limited to the above-described conveyance belt system. It is allowable to use a system to attract the sheet material 10 using a plurality of suction ports and convey the sheet material 10 in the sub-scanning direction using the drive of the conveyance roller pinching the sheet material 10.

Figure 4:
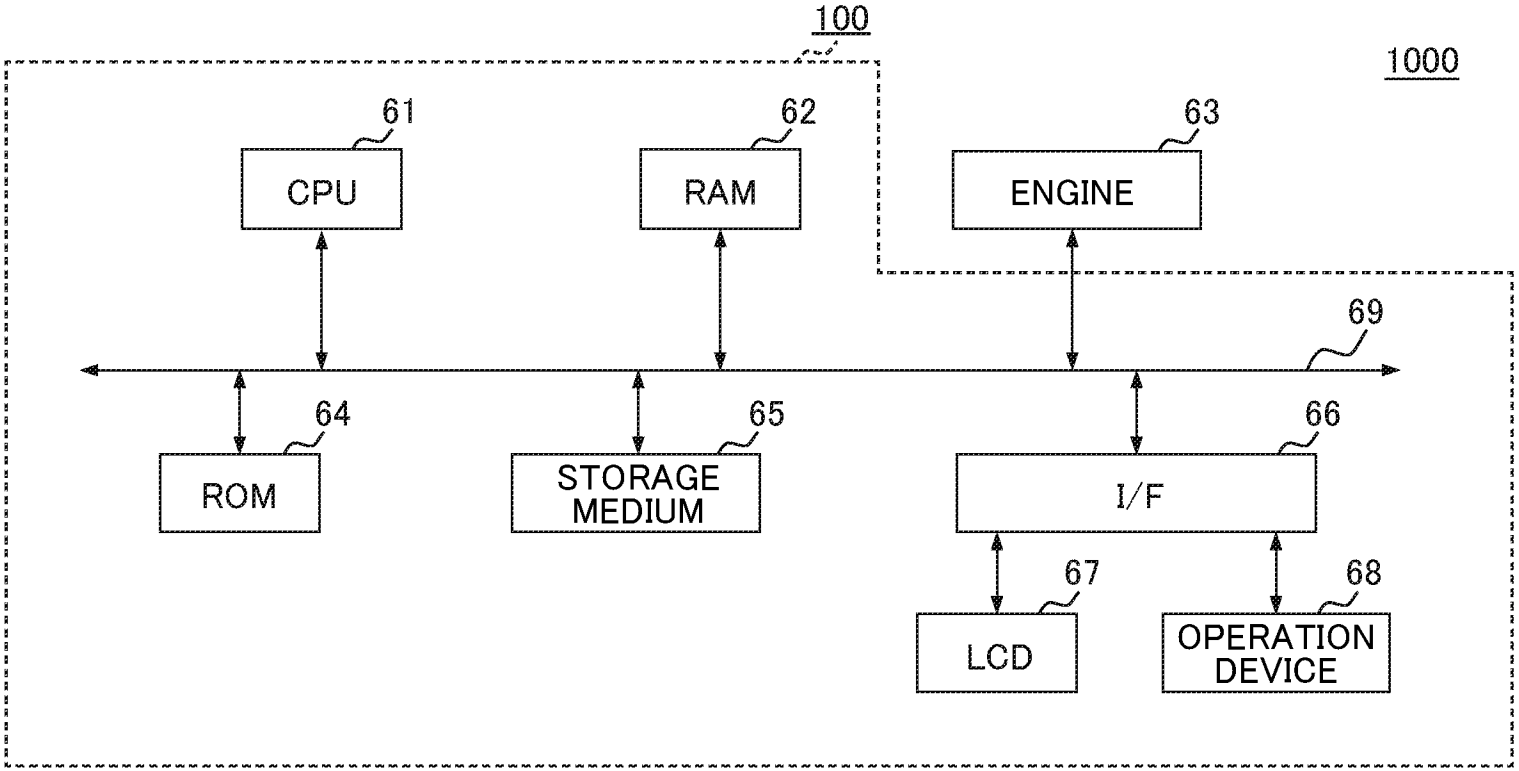
FIG. 4 is a block diagram illustrating a hardware configuration according to an embodiment of the present disclosure.

Next, a hardware configuration of the liquid discharge apparatus 1000 according to the present embodiment will be described with reference to FIG. 4. FIG. 4 is a block diagram illustrating a hardware configuration of the liquid discharge apparatus 1000 according to the present embodiment.

As illustrated in FIG. 4, the liquid discharge apparatus 1000 according to the present embodiment includes an engine 63 for driving the carriage 3, the pump 53, or the like, that execute image formation, in addition to the configuration similar to a computer such as a general server or a personal computer (PC).

That is, the liquid discharge apparatus 1000 is configured such that a central processing unit (CPU) 61, a random access memory (RAM) 62, a read only memory (ROM) 64, an engine 63, a storage medium 65 such as a hard disk drive (HDD), and an interface (I/F) 66 are interconnected via a bus 69. The I/F 66 is further connected to a liquid crystal display (LCD) 67 and an operation device 68.

The CPU 61 is an arithmetic unit and controls operation of the entire liquid discharge apparatus 1000. The RAM 62 is a volatile storage medium capable of high-speed reading and writing of information, and is used as a work region when the CPU 61 processes information. The ROM 64 is a read only non-volatile storage medium, and stores programs such as firmware. The engine 63 is a mechanism that actually executes image formation in the liquid discharge apparatus 1000, and includes the above-described liquid discharge head 4 and a mechanism for conveying continuous sheets.

The storage medium 65 is a non-volatile storage medium capable of reading and writing information, and stores an operating system (OS), various control programs, application programs, or the like. The I/F 66 performs connection of the bus 69 with various hardware, networks, or the like, and controls the connection. The LCD 67 is a visual user interface used by the user to confirm the state of the liquid discharge apparatus 1000. The operation device 68 is a user interface such as a keyboard and a mouse used by the user to input information to the liquid discharge apparatus 1000.

In such a hardware configuration, a program stored in the ROM 64, the storage medium 65, or a recording medium such as an optical disk is read out to the RAM 62, and program operation is performed under the control of the CPU 61 serving as control circuitry, thereby constituting a control unit 100. The control unit 100 constituted as described above is combined with hardware so as to constitute functional blocks to implement functions of the liquid discharge apparatus 1000 according to the present embodiment.

Figure 5:
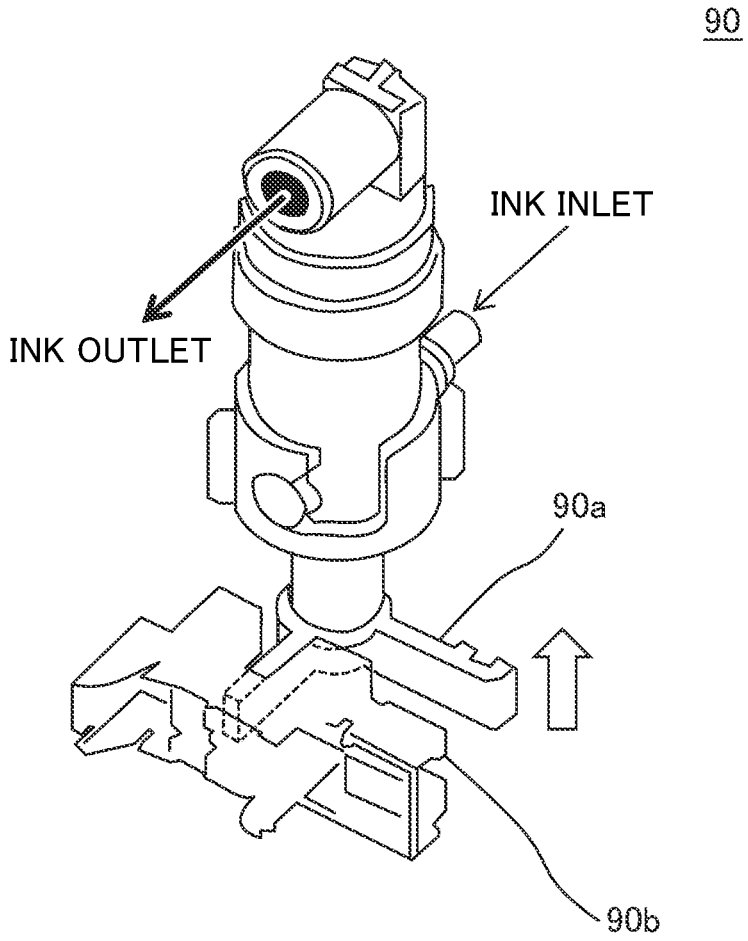
FIG. 5 is a block diagram of an ink end detection mechanism according to an embodiment of the present disclosure.

FIG. 5 is a perspective view illustrating appearance of a detector 90 that detects an ink end, in other words, a low level tank, according to the present embodiment. When the pump 53 is driven when ink end at the cartridge 55 is detected in the liquid discharge apparatus 1000, there is no suppliable ink inside the cartridge 55, and this turns an ink supply path between the cartridge 55 and the pump 53 into a negative pressure state.

This negative pressure state causes a fluctuation site of the detector 90 to rise, and this leads to a rise in a filler 90*a*. A sensor 90*b* detects the position of the filler 90*a*, enabling the detector 90 to detect whether the pressure in the ink supply path is a predetermined value or less. That is, since the ink end of the cartridge 55 can be determined by the detection by the filler 90*a* in the sensor 90*b*, the detector 90 functions as a pressure detection mechanism.

Note that the fluctuation site provided in the detector 90 is configured to fluctuate due to a certain pressure or more by an elastic body such as a spring. Therefore, pressure fluctuation that might occur inside the tube 56 or the like when the cartridge 55 is removed would lead to displacement of a fluctuation site of the detector 90, and this might cause mixture of air into the tube 56.

For example, since white ink has large pigment particles, it is necessary to shake the cartridge 55 to prevent precipitation of pigment components. At this time, the cartridge 55 is preferably removed from the pump 53. When the cartridge 55 and the pump 53 are disconnected in this manner, mixture of air into the ink supply path is likely to occur. Air flowing into the ink supply path might cause erroneous detection of the ink end.

Therefore, as will be described below, the liquid discharge apparatus 1000 according to the present embodiment includes an ink supply path having a configuration capable of suppressing a factor that causes such erroneous detection of ink end. This configuration makes it possible to detect ink end with high accuracy.

Next, an ink supply path in the liquid discharge apparatus 1000 will be described. As described with reference to FIGS. 1 to 3, the liquid discharge apparatus 1000 includes: a plurality of the cartridge holders 54 each filled with ink; and a plurality of the liquid discharge heads 4. The cartridge holder 54 corresponds to an ink tank filled with ink corresponding to each of colors. As illustrated in FIG. 2, the liquid discharge apparatus 1000 includes four cartridge holders 54 and four liquid discharge heads 4. Therefore, the liquid discharge apparatus 1000 is compatible with not merely the ink of basic four-colors (CMYK) but also special color inks such as orange, gray and white with different type of piping for the tube 56.

Figure 6:
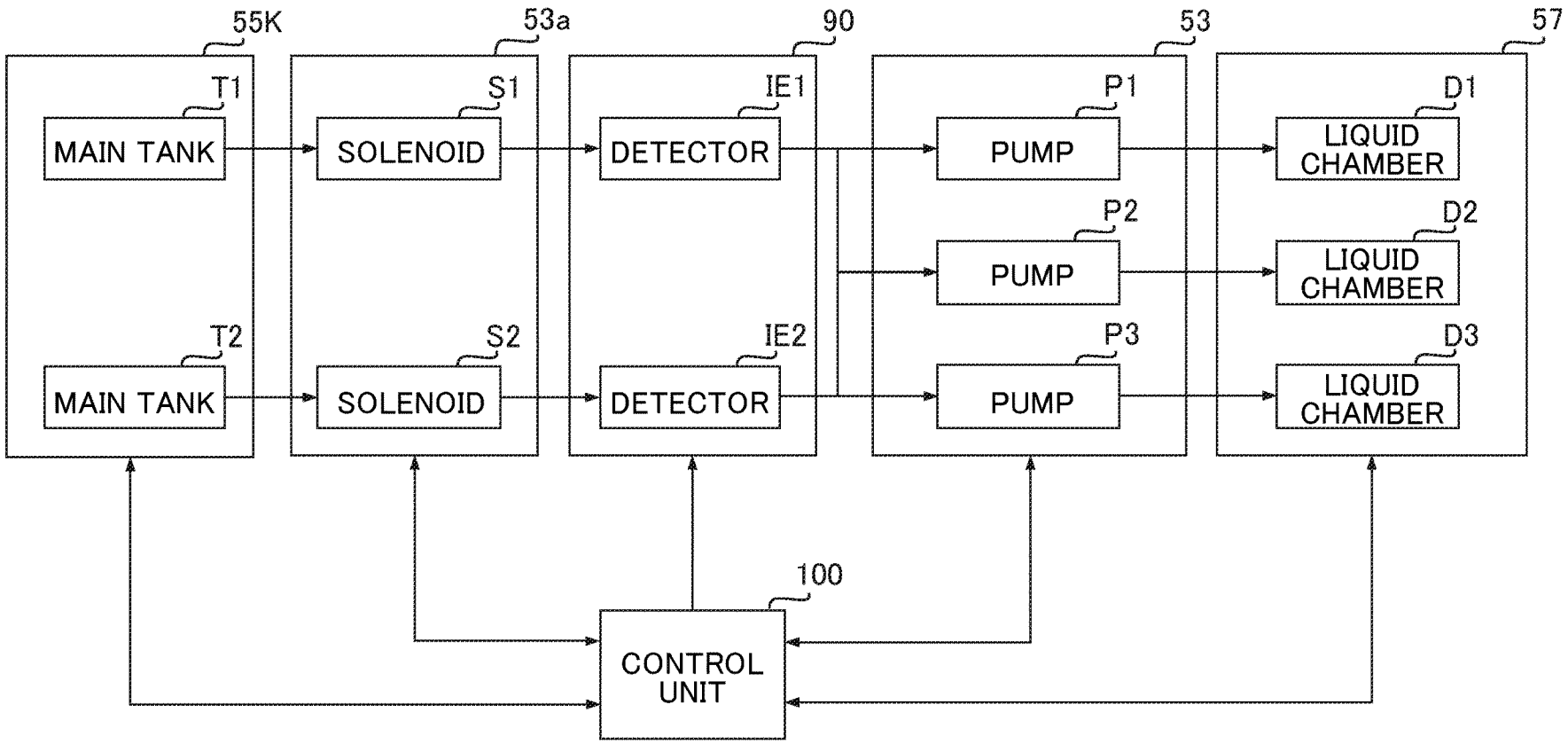
FIG. 6 is a block diagram of a supply path, according to a first example, that supplies ink from a cartridge to a liquid discharge head.
Figure 7:
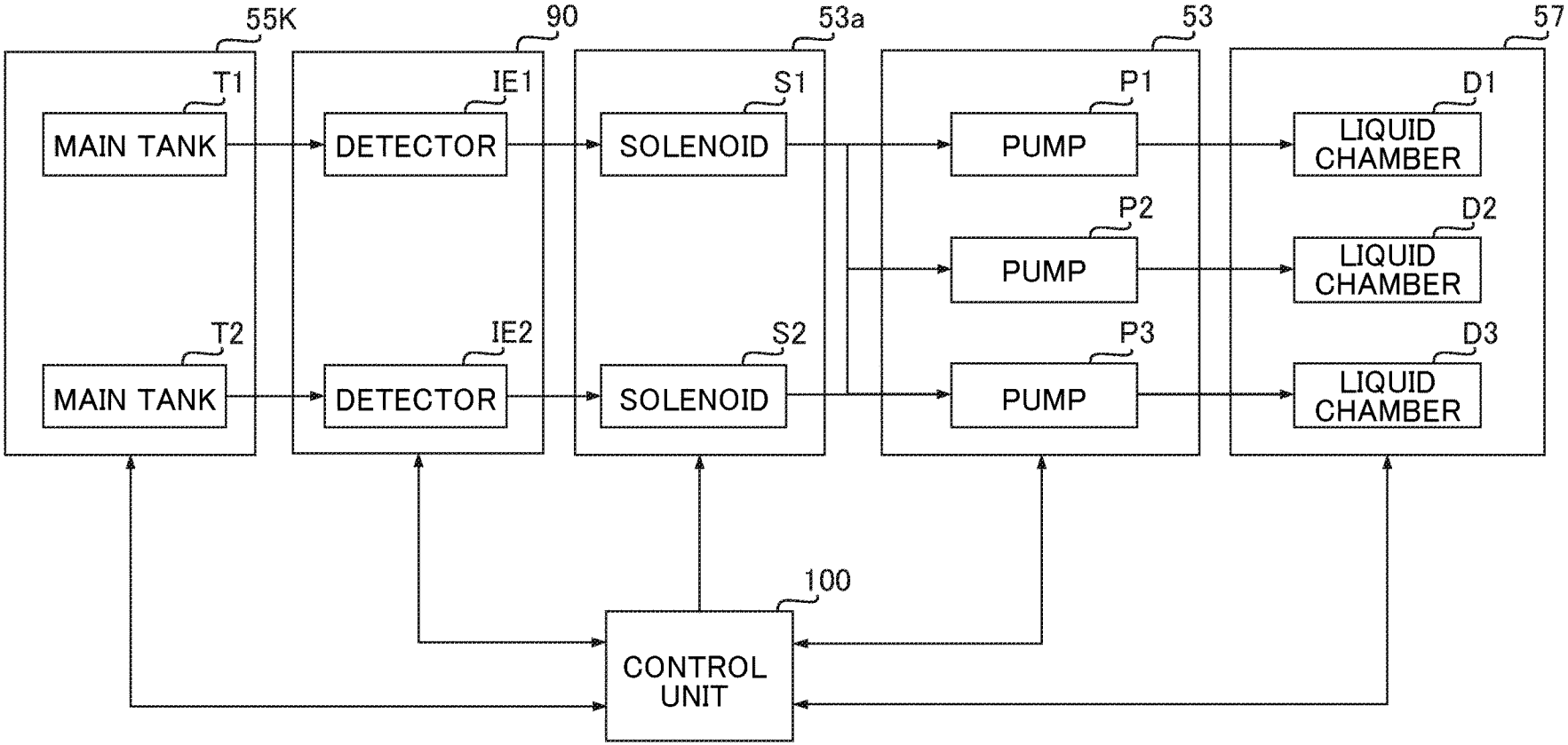
FIG. 7 is a block diagram of a supply path, according to a comparative example presented in contrast to the first example, that supplies ink from a cartridge to a liquid discharge head.
Figure 8:
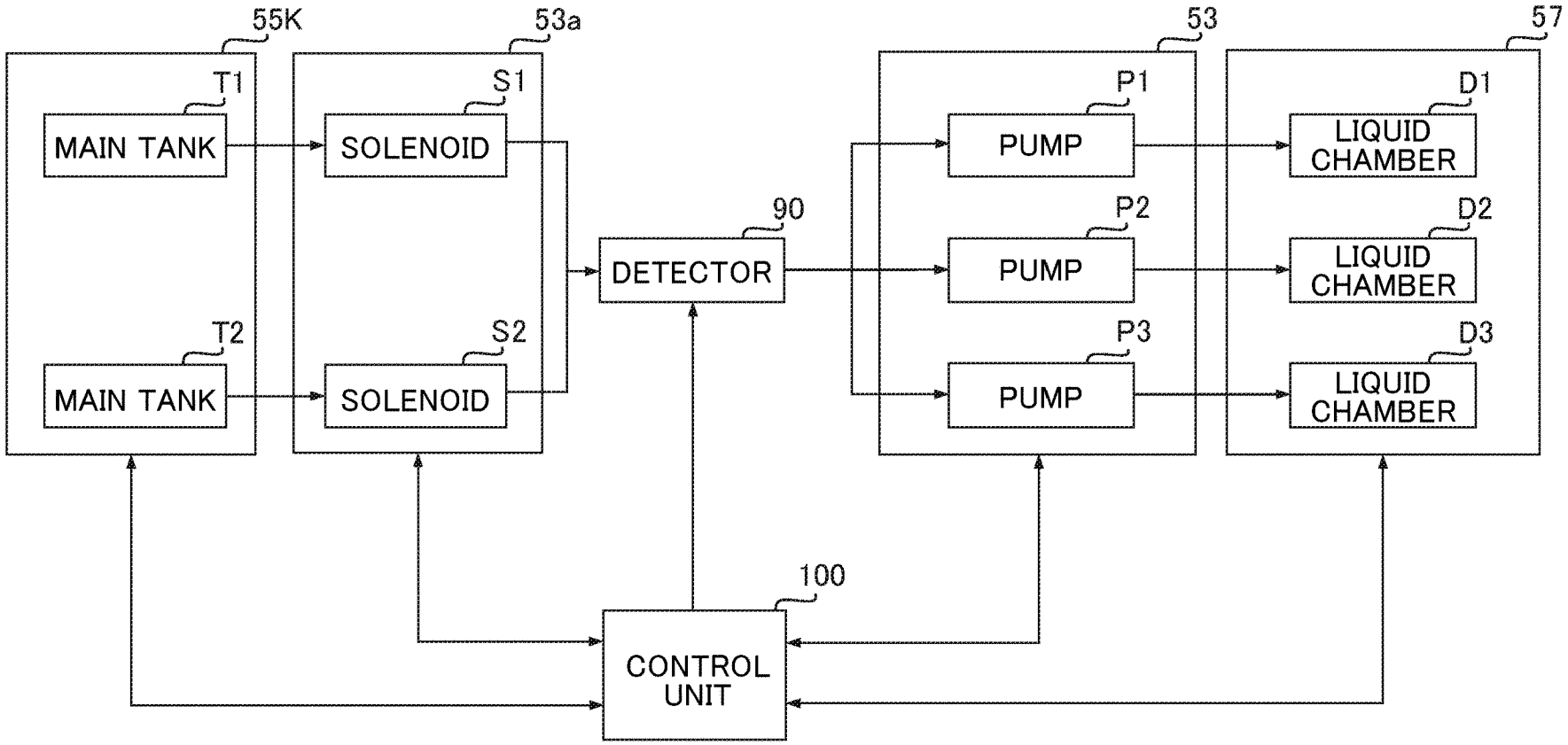
FIG. 8 is a block diagram of a supply path, according to a second example, that supplies ink from a cartridge according to an embodiment of the present disclosure to a liquid discharge head.

Further, depending on the piping of the tube 56, the liquid discharge apparatus 1000 can be configured to be able to supply the ink to the plurality of liquid discharge heads 4 from the plurality of main tank devices 55K of the same color. FIG. 6 is a diagram illustrating an example of an ink supply path in the liquid discharge apparatus. The ink supply path illustrated in FIGS. 6 to 8 is provided between the cartridge holder 54 and the liquid discharge head 4.

FIG. 6 illustrates an ink supply path according to the first example of the present disclosure, which is an example of a path for supplying ink from the main tank device 55K including the main tanks T1 and T2. Here, connection of the main tank T1 and the solenoid S1 is provided independent from the connection of the main tank T2 and the solenoid S2. A solenoid device 53*a* is connected to the detector 90 including individual detectors 1E1 and 1E2. Note that connection of the solenoid S1 and the individual detector 1E1 is independent from the connection of the solenoid S2 and the individual detector IE2. The detector 90 is connected to the pump 53 including individual pumps P1, P2, and P3. The individual detectors IE1 and IE2 are connected to the individual pumps P1, P2 and P3 by the same path. The individual pumps P1, P2, and P3 of the pump 53 are respectively connected to individual liquid chambers D1, D2, and D3 of the liquid chamber 57, independent from each other. The control unit 100 transmits and receives control signals to and from the main tank device 55K, the solenoid device 53*a,* the detector 90, the pump 53, and the liquid chamber 57. With this configuration, ink can be supplied from the main tank device 55K to the individual liquid chambers D1, D2, and D3 in accordance with the control signal from the control unit 100. The solenoid device 53*a* corresponds to a liquid supply regulator. The detector 90 corresponds to a pressure detector.

In the configuration illustrated in FIG. 6, the control unit 100 controls solenoids S1 and S2 being liquid supply regulators to open or block the ink supply path, thereby making it possible to select either the main tank T1 or T2 to supply the ink. For example, in order to supply the ink from the main tank T1 to the individual liquid chamber D3, the control unit 100 controls to open the solenoid S1 and drive the pump P3.

In this manner, with the configuration enabling the use of the plurality of main tanks T1 and T2 supplying the same color ink, even when the ink end is detected for one main tank (main tank T1) for example, it is still possible to switch to another main tank (main tank T2) to supply the ink.

Furthermore, in a case where the ink remaining amounts are different or the expiration dates of the ink are different between the main tanks T1 and T2, the control unit 100 can control which of the main tanks are to be used to supply the ink.

Meanwhile, in the ink supply path of FIG. 7 illustrated as a comparative example, the detector 90 is provided between the main tank device 55K and the solenoid device 53*a*. In such an ink supply path configuration, since the individual detectors 1E1 and IE2 are located immediately downstream of the ink supply path from the main tanks T1 and T2, there might be a concern of occurrence of air mixture into the supply path by inserting and removing the main tanks T1 and T2.

In the ink supply path illustrated in FIG. 6 which is the first example of the present disclosure, closing the solenoids S1 and S2 makes it possible to suppress displacement of the individual detectors 1E1 and IE2 due to pressure fluctuations at the time of insertion and removal of the main tanks T1 and T2, eliminating the concern of mixture of air into the ink supply path.

In the configuration of the ink supply path illustrated in FIG. 6, however, two ink end detection mechanisms, namely, the individual detectors IE1 and IE2 are included in the ink supply path connected from each of the solenoids S1 and S2 to the individual pumps P1, P2 and P3.

In this configuration, when the pump 53 (including any one of the individual pumps P1, P2 and P3) operates when ink end occurs in the main tank T1, for example, both of the individual detectors IE1 and IE2 would detect negative pressure. In this case, the control unit 100 might erroneously detect that the ink end occurs in the main tank T2.

Figure 9:
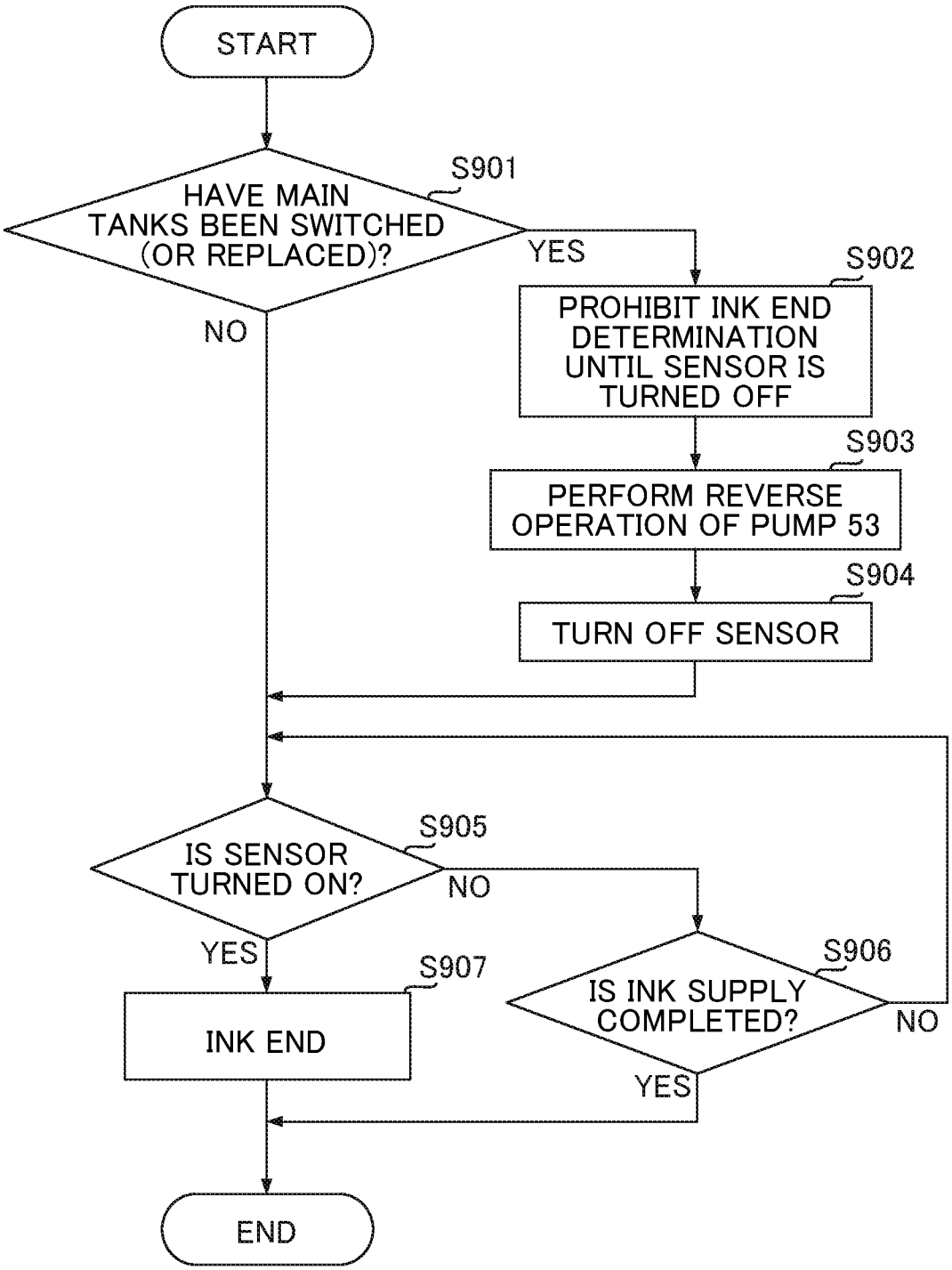
FIG. 9 is a flowchart illustrating a flow of processing of detecting ink end according to an embodiment of the present disclosure.

To overcome this, in the liquid discharge apparatus 1000 according to the present embodiment, the main tanks T1 and T2 are switched (or replaced), and thereafter ink end is detected on the basis of the steps in each of processing illustrated in the flowchart of FIG. 9 to prevent erroneous detection of the ink end.

FIG. 9 is a flowchart illustrating a flow of processing of detecting ink end according to the present embodiment. First, the control unit 100 determines whether the main tanks T1 and T2 have been switched (or replaced) (S901).

When the main tanks T1 and T2 have been switched (or replaced) (S901/YES), the control unit 100 prohibits ink end determination for the main tanks T1 and T2 until the sensor 90*b* of the detector 90 is turned off (S902). That is, in S902, the detector 90 is set to a determination prohibition state. After the detector 90 is in the determination prohibition state and the sensor 90*b* is in the OFF state, the control unit 100 proceeds to the processing of S903.

In a case where the main tanks T1 and T2 are not switched (or after being replaced) (S901/NO), or in a case where the timing is after the main tanks T1 and T2 have been switched (or after being replaced) (S901/YES) and the sensor 90*b* is turned off (S904), the control unit 100 determines whether the sensor 90*b* is turned on (S905).

In a case where the sensor 90*b* is not in the ON state (S905/NO), the control unit 100 waits until completion of the ink supply from the main tanks T1 and T2 to the individual liquid chambers D1, D2 and D3 (S906/YES), and then finishes the present processing.

In a case where the sensor 90*b* is in the ON state (S905/YES), the control unit 100 determines (S907) that one of the main tanks T1 and T2 is in the ink end state on the basis of control signals of the solenoids S1 and S2 at the timing of S905, and then, finishes the present processing. Accordingly, the control unit 100 has a function to determine which of the main tanks T1 and T2 is in the ink end state.

In this manner, the liquid discharge apparatus 1000 according to the present embodiment prohibits the ink end determination until the sensor 90*b* is turned off immediately after the main tanks T1 and T2 are switched, and performs reverse operation of the pump 53 until the sensor 90*b* is turned off, and thereafter resumes ink end determination so as to prevent erroneous detection of the ink end. Therefore, it is possible to accurately detect which of the main tanks T1 and T2 is in the state of the ink end.

Once ink end is determined in the main tank T1 or T2, it is preferable to cancel the negative pressure state of the ink supply path from the main tanks T1 and T2 to the individual pumps P1, P2 and P3.

In a case where the individual pumps P1, P2 and P3 are reversely operated (for maintenance at the time of the ink end) in order to cancel the negative pressure state of the ink supply path, the control unit 100 executes processing of determining which pump 53 of the plurality of individual pumps P1, P2 and P3 in the same path is to be reversely operated.

Figure 10:
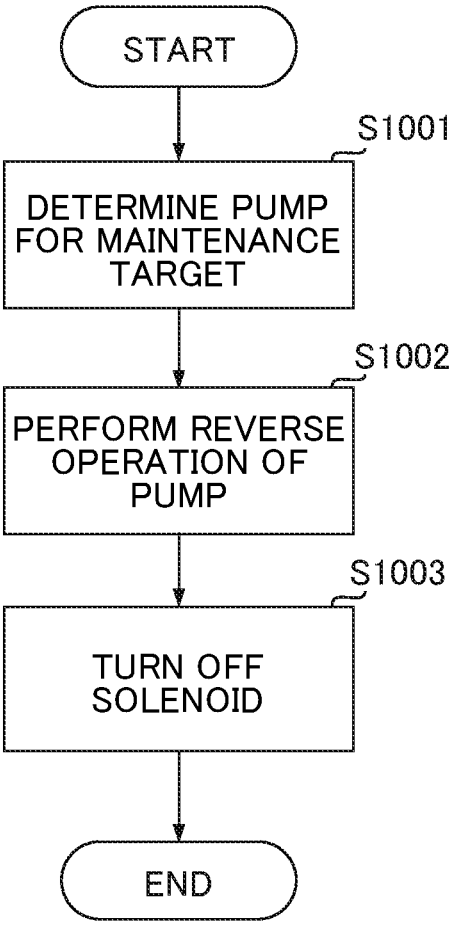
FIG. 10 is a flowchart illustrating a flow of maintenance processing after ink end detection according to an embodiment of the present disclosure.

FIG. 10 is a flowchart illustrating a flow of maintenance processing after ink end detection according to the present embodiment. The control unit 100 determines the pump 53 (one of the individual pumps P1, P2, and P3) to be reversely operated on the basis of the control signals of the solenoids S1 and S2 for ink end determination (S1001). In this determination, the pump 53 (one of the individual pumps P1, P2, and P3) used at the occurrence of ink end (S906 in FIG. 9) is set as the target of the reverse operation.

Next, the control unit 100 performs reverse operation (S1002) of the pump 53 (for example, the individual pump P1) determined in S1001, and turns off the control signal of the solenoid S1 (or S2) related to the control signal used for ink end determination (S1003) to finish the present processing.

In this manner, the liquid discharge apparatus 1000 according to the present embodiment uses, as a target of reverse operation, the pump 53 used at the time of occurrence of ink end. This makes it possible to perform maintenance after ink end detection with the same control even in the equipment having many types of color configurations.

Next, FIG. 8 illustrates an ink supply path which is a configuration example of an ink supply path for supplying ink from the plurality of main tanks T1 and T2 and which is the second example of the present disclosure. The detector 90 connected between the solenoid device 53*a* and the pump 53 in the ink supply path according to the second example is implemented by a single detector 90. Other configurations are similar to the configuration of the ink supply path illustrated in FIG. 6.

Similarly to FIG. 6, the configuration of the ink supply path illustrated in FIG. 8 includes the solenoids S1 and S2 immediately downstream of the ink supply path from the main tanks T1 and T2. This configuration can eliminate the concern of mixture of air into the ink supply path by the insertion and removal of the main tanks T1 and T2.

Furthermore, since the control unit 100 controls the opening and closing of the solenoids S1 and S2, the control unit 100 can identify the main tank T1 (or T2) supplying the ink on the basis of opening and closing conditions of the solenoids S1 and S2. Accordingly, the control unit 100 determines the main tank (for example, the main tank T1) supplying ink at a timing when the ink end is detected by the single detector 90 as ink end on the basis of control signals of the solenoids S1 and S2.

In addition, the configuration of the ink supply path illustrated in FIG. 8 is implemented by the single detector 90, making it possible to reduce the number of components constituting the liquid discharge apparatus 1000. Consequently, the configuration of the ink supply path illustrated in FIG. 8 enables the ink supply from the plurality of main tanks T1 and T2 to the plurality of individual liquid chambers D1, D2 and D3, and further enables high accuracy detection of ink end while preventing mixture of air due to the insertion and removal of the main tanks T1 and T2. Furthermore, there is an advantage in the configuration using the single detector 90 that the negative pressure for detecting the ink end is half the case of the detector 90 illustrated in FIG. 6, making it also possible to achieve high detection accuracy and prevent unexpected erroneous detection of ink end.

When the ink end is detected, the control unit 100 performs reverse operation of the individual pumps P1, P2 and P3 (operation to drive the individual pumps P1, P2 and P3 to run the ink in the reverse direction to the normal supply direction of the ink). The reverse operation of the individual pumps P1, P2 and P3 cancels the negative pressure state between the main tanks T1 and T2 and the individual pumps P1, P2 and P3, turning off the sensor 90*b* of the detector 90.

In a case, however, where the ink end is detected for the main tank T1 and ink supply has been switched to the other tank, namely, the main tank T2, the control unit 100 cannot perform reverse operation of the individual pumps P1, P2, or P3. Accordingly, the detector 90 keeps detecting the negative pressure state of the ink supply path, leading to erroneous detection that ink end is also occurring in the main tank T2.

To overcome this, in the liquid discharge apparatus 1000 according to the present embodiment, the main tanks T1 and T2 are switched (or replaced), and thereafter ink end is detected on the basis of the processing flow illustrated in the flowchart of FIG. 9 to prevent erroneous detection of the ink end. Furthermore, performing the maintenance processing after ink end detection illustrated in FIG. 10 similarly to the above-described example would cancel the negative pressure in the ink supply path.

In the present application, the "liquid discharge apparatus" is an apparatus that includes a liquid discharge head or a liquid discharge unit and that drives the liquid discharge head to discharge the liquid. The liquid discharge apparatus includes not merely an apparatus capable of discharging a liquid to a liquid stickable material but also an apparatus that discharges a liquid towards air or liquid.

The "liquid discharge apparatus" can include a unit related to feeding, conveying, sheet discharge of the liquid stickable material, a preprocessing apparatus, a post-processing apparatus, or the like.

Examples of the "liquid discharge apparatus" include an image forming apparatus which is an apparatus that discharges ink to form an image on a sheet, and a solid object modeling apparatus (three-dimensional modeling apparatus) that discharges a modeling liquid onto a powder layer formed with layers of powdery material in order to form a solid model (three-dimensional model).

The "liquid discharge apparatus" is not limited to an apparatus by which significant images such as letters, graphics, etc. are visualized by the discharged liquid. For example, an apparatus that forms a pattern or the like that has no meaning, and an apparatus that shapes a three-dimensional image are included.

The above "liquid stickable material" represents a material to which a liquid can be stuck at least temporarily, stuck and adhered, stuck and permeated, or the like. Specific examples include media such as recording media including a sheet, recording paper, a recording sheet, a film, a cloth, or an electronic substrate, electronic components such as piezoelectric elements, powdery material layer (powder layer), organ model, inspection cells. In short, the "liquid stickable material" includes all materials to which a liquid can stick unless specifically limited.

The above-described "liquid stickable material" may be any material as long as a liquid can stick even temporarily, such as a sheet, thread, fiber, cloth, leather, metal, plastic, glass, wood, or ceramics.

The "liquid" to be discharged from the "liquid discharge head 4" may have any viscosity and surface tension that can be discharged from the head, and is not limited in particular. Still, it is preferable that the viscosity of the discharged liquid is 30 mPa·s or less at ordinary temperature and ordinary pressure or by heating and cooling.

More specifically, the liquid may be, for example, a solvent such as water or an organic solvent, a colorant such as a dye or a pigment, or a solution containing a functionalizing material such as a polymerizable compound, a resin or a surfactant, a biocompatible material such as DNA, amino acid, protein, or calcium, or an edible material such as a natural pigment, suspension liquid, or emulsion. These liquids can be applied, for example, as an inkjet ink, a surface treatment liquid, formation liquid for constituents of an electronic element or a light-emitting element, or for an electronic circuit resist pattern, or as solution for three-dimensional modeling materials.

Examples of the "liquid discharge apparatus" include, but are not limited to, an apparatus in which a liquid discharge head and a liquid stickable material move relative to each other. Specific examples include a serial type apparatus for moving the liquid discharge head, and a line type apparatus not moving the liquid discharge head.

Other examples of the "liquid discharge apparatus" include: a treatment liquid application apparatus that discharges a treatment liquid onto a sheet in order to apply the treatment liquid to the surface of the sheet for the purpose of modifying the surface of the sheet; and an injection granulation apparatus that injects a composition liquid in which raw materials are dispersed in a solution through a nozzle to granulate fine particles as a raw material.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus comprising:

a liquid discharge head including a nozzle configured to discharge a liquid;

a pump configured to supply the liquid to the liquid discharge head;

a plurality of tanks configured to store the liquid;

a supply path configured to supply the liquid from the tanks to the liquid discharge head;

a plurality of liquid supply regulators provided for each of the tanks, and configured to open and block the supply path to regulate supply of the liquid from the tanks to the liquid discharge head;

a pressure detector disposed between the liquid supply regulators and the liquid discharge head in the supply path; and control circuitry configured to:

determine a low level tank among the tanks on basis of opening and closing conditions of the liquid supply regulators in a case where the pressure detector detects that a pressure of the supply path is lower than a predetermined value; and control the liquid supply regulators to supply the liquid from at least one tank of the tanks to the liquid discharge head.

2. The liquid discharge apparatus according to claim 1, wherein the control circuitry is configured to:

prohibit the pressure detector from determining the low level tank in a case where the control circuitry detects that one of the tanks is switched or replaced;

perform reverse operation of the pump to cancel a negative pressure generated in the supply path; and control the pressure detector to resume determination of the low level tank after cancellation of the negative pressure.

3. The liquid discharge apparatus according to claim 2, wherein the control circuitry is configured to:

determine the low level tank in a case where the pressure detector is in a determination enabled state; and detect completion of supply of the liquid to the liquid discharge head and finish processing in a case where the pressure detector is in a determination prohibition state.

4. The liquid discharge apparatus according to claim 1, wherein the pump includes a plurality of pumps.

5. The liquid discharge apparatus according to claim 4, wherein the control circuitry is configured to:

determine a pump as a maintenance target among the pumps;

perform reverse operation of the pump determined as the maintenance target; and block the supply path.

6. A liquid discharge apparatus comprising:

a liquid discharge head including a nozzle which discharges a liquid;

a pump supplying the liquid to the liquid discharge head;

a plurality of tanks storing the liquid;

a supply path supplying the liquid from the tanks to the liquid discharge head;

a plurality of liquid supply regulators provided for each of the tanks, the liquid supply regulators controlling a flow of the liquid from the tanks to the liquid discharge head;

a pressure detector disposed between the liquid supply regulators and the liquid discharge head in the supply path; and control circuitry determining a low level tank among the tanks on basis of a condition of each of the liquid supply regulators in a case where the pressure detector detects a pressure of the supply path that is lower than a predetermined value, the control circuitry controlling the liquid supply regulators to supply the liquid from at least one tank of the tanks to the liquid discharge head.

7. The liquid discharge apparatus according to claim 6, wherein the control circuitry prohibits the pressure detector from determining the low level tank in a case where the control circuitry detects that one of the tanks is switched or replaced, performs reverse operation of the pump to cancel a negative pressure generated in the supply path, and controls the pressure detector to resume determination of the low level tank, after cancellation of the negative pressure.

8. The liquid discharge apparatus according to claim 7, wherein the control circuitry determines the low level tank in a case where the pressure detector is in a determination enabled state, detects completion of supply of the liquid to the liquid discharge head, and finishes processing in a case where the pressure detector is in a determination prohibition state.

9. The liquid discharge apparatus according to claim 7, wherein the pump includes a plurality of pumps.

10. The liquid discharge apparatus according to claim 9, wherein the control circuitry determines a maintenance target pump among the pumps, performs reverse operation of the pump determined as the maintenance target, and blocks the supply path.

11. A control method for a liquid discharge apparatus that includes: a liquid discharge head including a nozzle configured to discharge a liquid; a pump configured to supply the liquid to the liquid discharge head; a plurality of tanks configured to store the liquid; a supply path configured to supply the liquid from the tanks to the liquid discharge head; a plurality of liquid supply regulators provided for each of the tanks, and configured to open and block the supply path to regulate supply of the liquid from the tanks to the liquid discharge head; a pressure detector disposed between the liquid supply regulators and the liquid discharge head in the supply path; and control circuitry configured to control the liquid supply regulators to supply the liquid from at least one tank of the tanks to the liquid discharge head, the method comprising determining a low level tank among the tanks on basis of opening and closing conditions of the liquid supply regulators in a case where the pressure detector detects that a pressure of the supply path is lower than a predetermined value.

* * * * *